US006659157B1

(12) United States Patent
Suderman

(10) Patent No.: US 6,659,157 B1
(45) Date of Patent: Dec. 9, 2003

(54) OVERHEAD BI-FOLD DOOR CONSTRUCTION

(76) Inventor: Jim Suderman, 178 Willow Dr., Winkler, Manitoba (CA), R6W 1Y1

( * ) Notice: Subject to any disclaimer, the term of this patent is extended or adjusted under 35 U.S.C. 154(b) by 0 days.

(21) Appl. No.: 10/284,270

(22) Filed: Oct. 31, 2002

(51) Int. Cl.[7] ..... E05D 15/26

(52) U.S. Cl. ..... 160/213; 160/232

(58) Field of Search ..... 160/213, 232, 160/207, 199, 206, 229.1, 201, 236

(56) References Cited

U.S. PATENT DOCUMENTS 4,088,172 A * 5/1978 Pollock ..... 160/207 X
4,177,854 A * 12/1979 DeVore ..... 160/207
4,405,008 A * 9/1983 Hazlett ..... 160/213
4,637,446 A * 1/1987 McQueen et al. ..... 160/207

* cited by examiner

*Primary Examiner*—David Purol
(74) *Attorney, Agent, or Firm*—Adrian D. Battison; Ryan W. Dupuis; Michael R. Williams

(57) ABSTRACT

An overhead bi-fold door is provided having an upper section and a lower section which are hinged for movement relative to one another between a closed flat position and an open folded position. Each section includes side beams and a frame spanning the side beams which is recessed in relation to an outer surface of the side beams. Sheeted insulation is received within the recess on an outer side of the door so that cladding may be supported across an outer side of both the sheeted insulation and the side beams. The sheeted insulation being supported on an outer side of the frames provides an uninterrupted layer of insulation of constant thickness to prevent thermal leakage which otherwise occurs when insulation would normally be supported on an inner side of the frame in sections mounted between the frame members.

16 Claims, 9 Drawing Sheets

OVERHEAD BI-FOLD DOOR CONSTRUCTION

FIELD OF THE INVENTION

The present invention relates to construction of an overhead bi-fold door.

BACKGROUND

Overhead bi-fold doors are known for use in large buildings in which high clearances, wide spans and simple construction are desirable. Known types of overhead bi-fold doors commonly have a large frame including numerous frame members required for strength. Cladding is typically supported on an outer side of the door with insulation accordingly being provided against an inner side of the door. Due to the irregular surface of the beams forming the frame of the door along the inner side of the door, insulation is typically provided in panels which fit between the beams resulting in thermal leakage at the beams thus reducing the insulating value of the entire door.

SUMMARY

According to the present invention there is provided an overhead bi-fold door construction comprising a door member and mounting means for supporting the door member on a building, the door member comprising:

- a top beam extending along a top end of the door member;
- a bottom beam extending along a bottom end of the door member;
- two side beams extending along opposing sides of the door member;
- a hinged seam extending across the door member partway between the top and bottom beams of the door member and dividing each side beam into a respective upper section and a respective lower section;
- the door member being separated by the hinged seam into an upper panel including the top beam and the upper sections of the side beams and a lower panel including the bottom beam and the lower sections of the side beams;
- the upper and lower sections of the side beams being foldable relative to one another at the hinged seam between a closed position of the door member in which the upper and lower sections lie in a generally common upright plane and an open position of the door member in which the bottom beam is raised upwardly towards the top beam in relation to the closed position;
- an upper frame spanning the upper sections of side beams;
- a lower frame spanning the lower sections of the side beams;
- an outer surface of the upper and lower frames being recessed in relation to an outer surface of at least one of the top beam, the bottom beam and the side beams;
- sheeted insulation material being supported on the outer surface of the upper and lower frame; and
- cladding being supported on an outer side of the sheeted insulation material.

The use of insulation between the frame of the door and the cladding permits a continuous layer of insulation of substantially constant thickness to be provided. This minimizes thermal losses through the door. Furthermore a neater appearance results while permitting thicker beams to be used for additional strength along the top, bottom or sides of the door and optionally along the central hinged seam as well.

The outer surface of the upper frame is also preferably recessed in relation to an outer surface of both the bottom beam and the top beam, in addition to the outer surface of the side members.

In this arrangement, the outer surfaces of the top beam, the bottom beam and the respective sections of the side beams are preferably all substantially flush with one another.

The outer side of the sheeted insulation material may thus be arranged to lie flush with the outer surfaces of the top,beam, the bottom beam and the side beams.

The cladding preferably overlaps the outer side of the sheeted insulation material and the outer surfaces of the top beam, the bottom beam and the side beams.

Preferably, the sheeted insulation material spans the door member substantially uninterrupted at a substantially constant thickness between the side beams and between the top and bottom beams.

The sheeted insulation material may be divided at the hinged seam in a manner so as to define a pair of abutting surfaces of the sheeted material in the closed position of the door member in which the abutting surfaces are preferably capped by a suitable cladding material.

Each of the upper and lower frames may include a cross beam extending along the hinged seam having an outer surface which is recessed in relation to the side beams. In this instance, the sheeted material preferably extends between the cross beams and the cladding.

Each of the upper and lower frames may additionally include a layer of inner sheeted material spanning the side beams between the respective frame and the sheeted insulation material.

BRIEF DESCRIPTION OF THE DRAWINGS

In the accompanying drawings, which illustrate an exemplary embodiment of the present invention.

DETAILED DESCRIPTION

Figure 1:
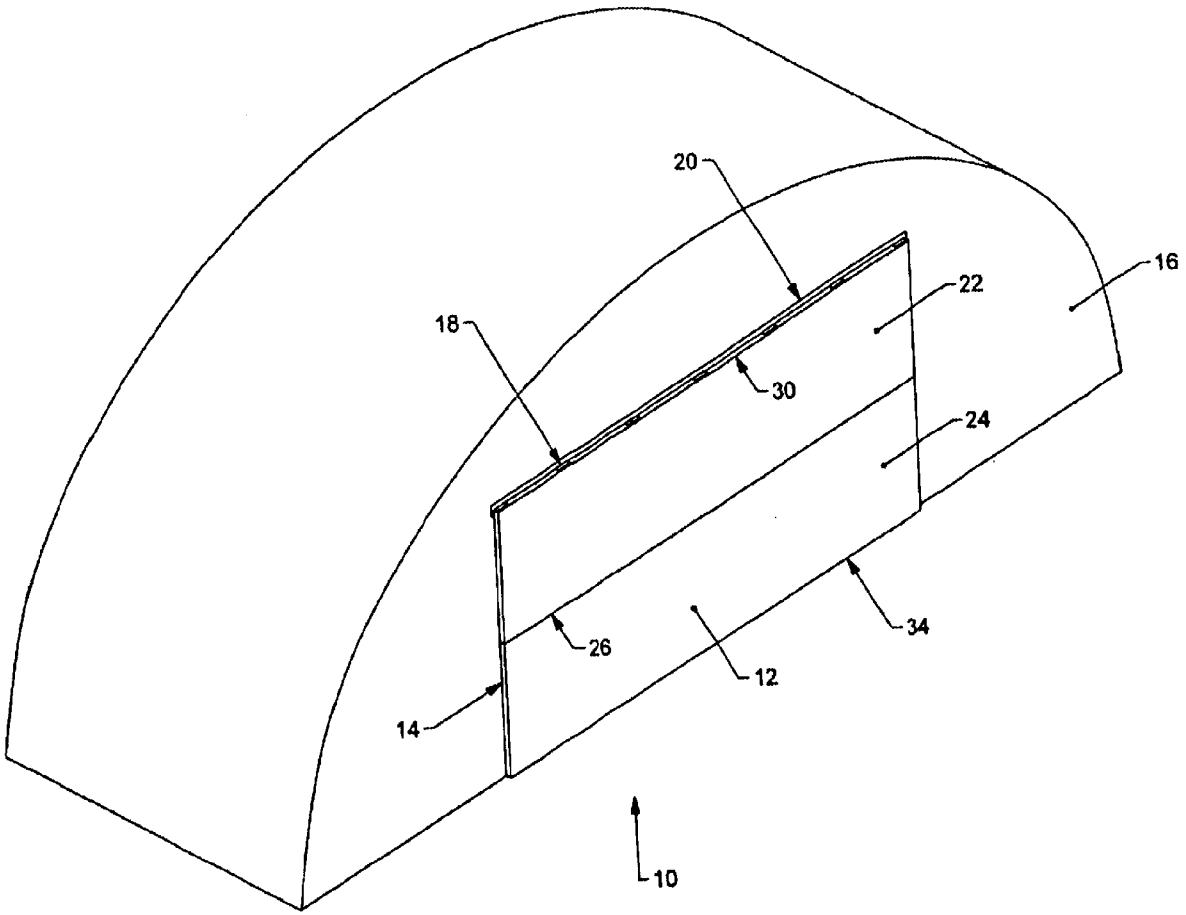
FIGS. 1 and 2 are isometric views of the door member shown supported on a building in respective closed and open positions.

Referring to the accompanying drawings, there is illustrated an overhead bi-fold door construction generally indicated by reference numeral 10. The door construction includes a door member 12 which is arranged to span the door opening 14 in a building 16 in a closed position of the door member. The door construction includes a plurality of hinge brackets 18 which are mounted at spaced positions along the top of the door member for securement to a header 20 of the building extending across a top end of the vertical door opening 14. Plural brackets are provided at spaced positions along the header.

Figure 2:
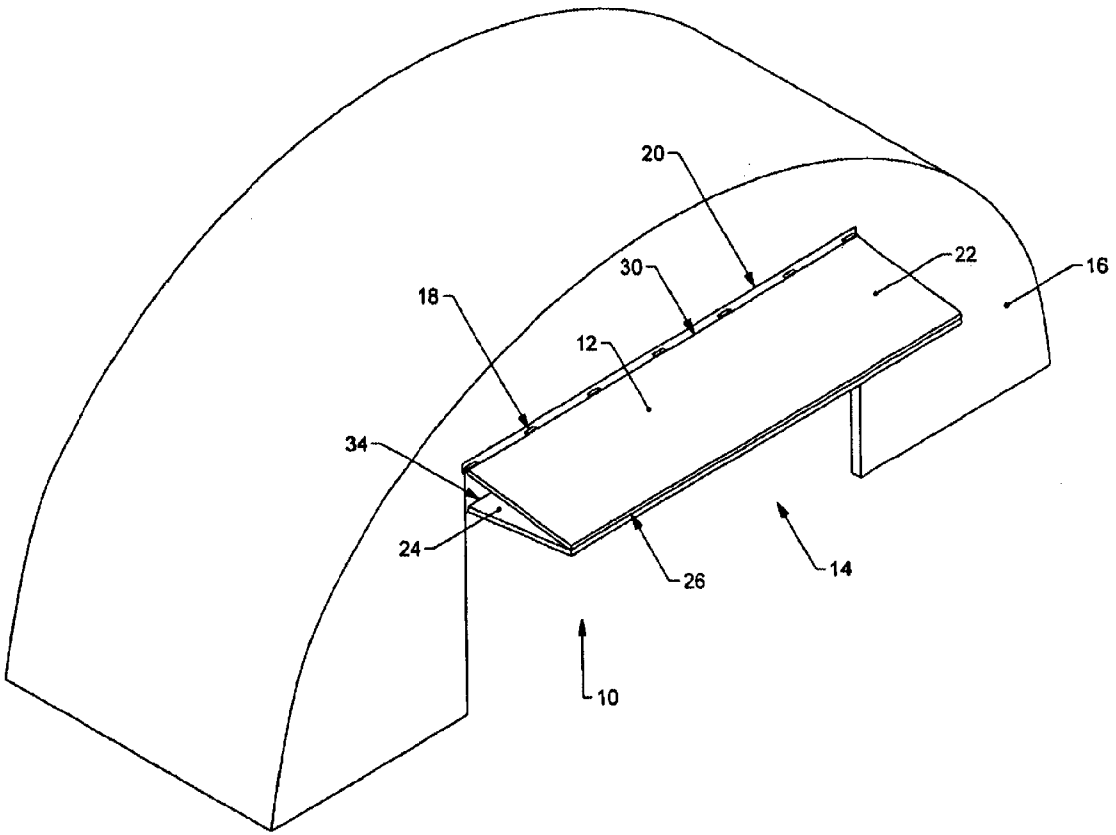
Figure 3:
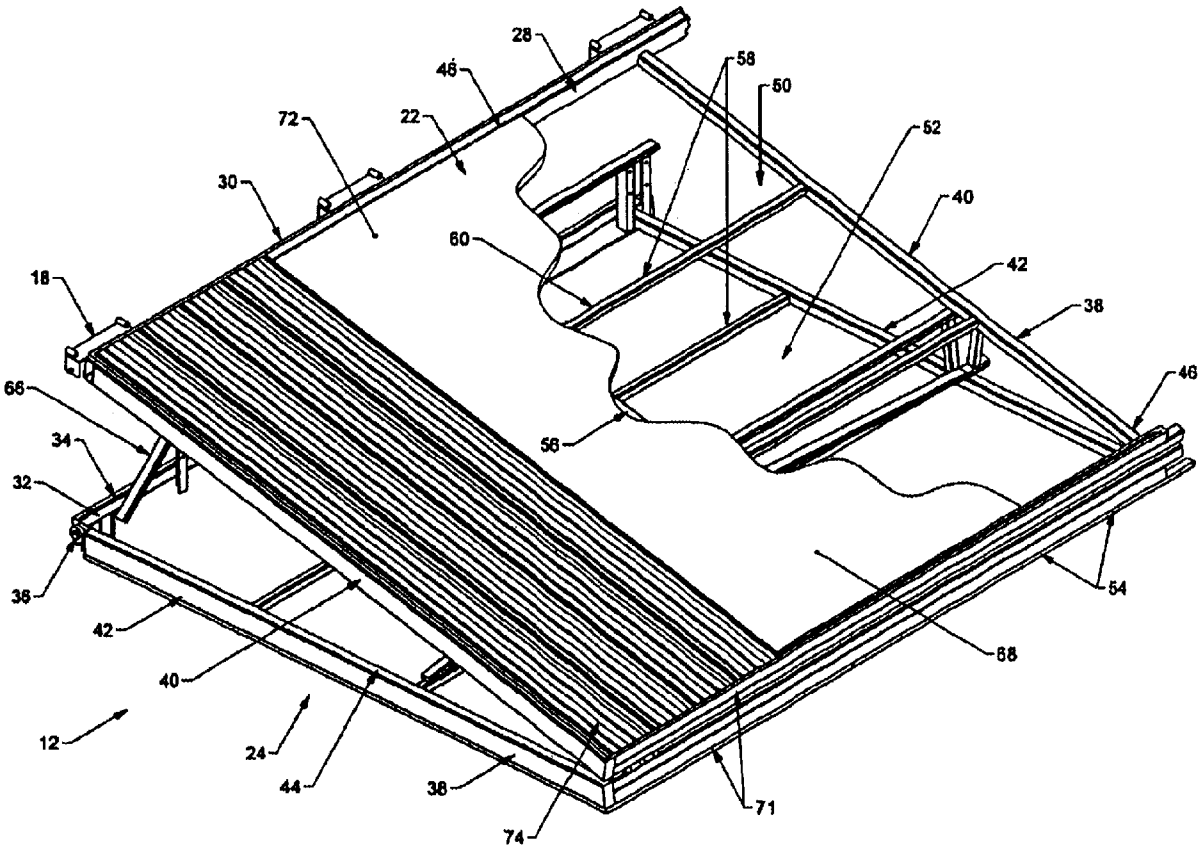
FIG. 3 is an isometric view of a portion of the door member shown with some of and cladding removed.
Figure 4:
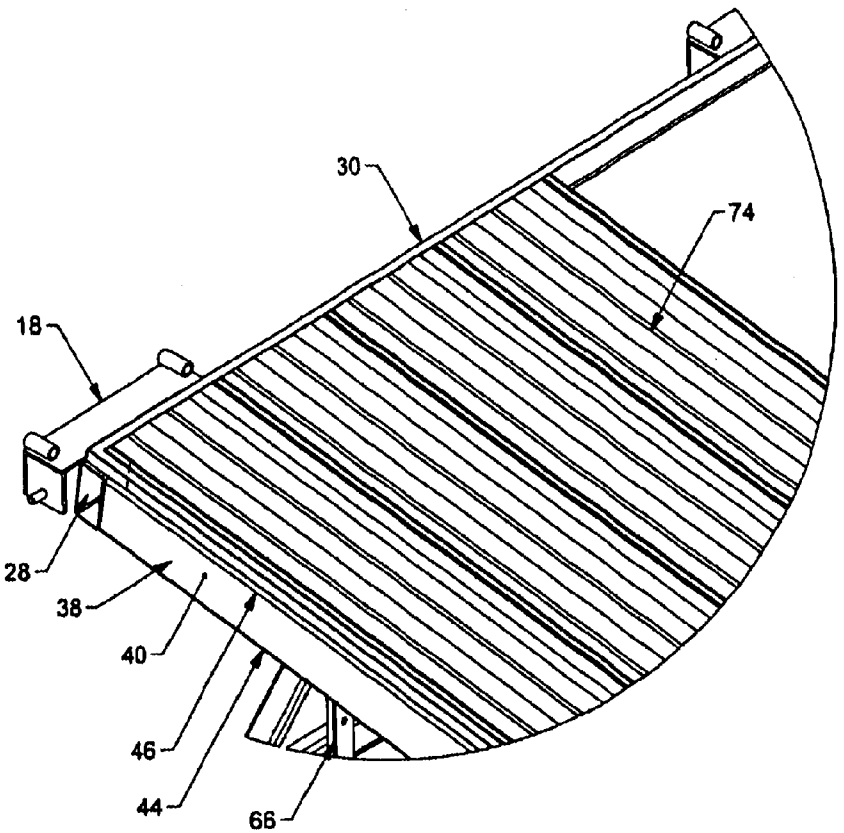
FIG. 4 is an enlarged isometric view of one of the top corners of the door member according to FIG. 3.
Figure 5:
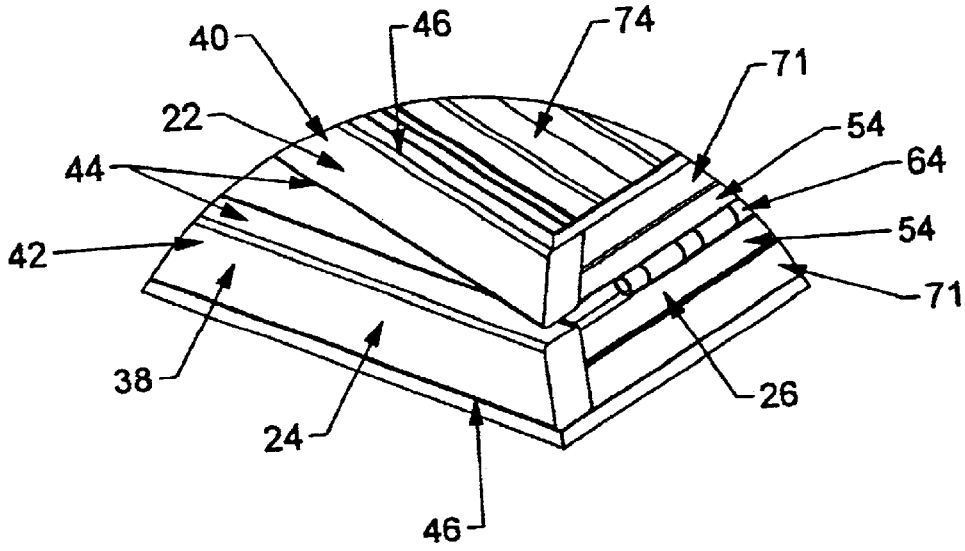
FIG. 5 is an enlarged isometric view of a portion of the side beams at the hinge seam according to FIG. 3.
Figure 6:
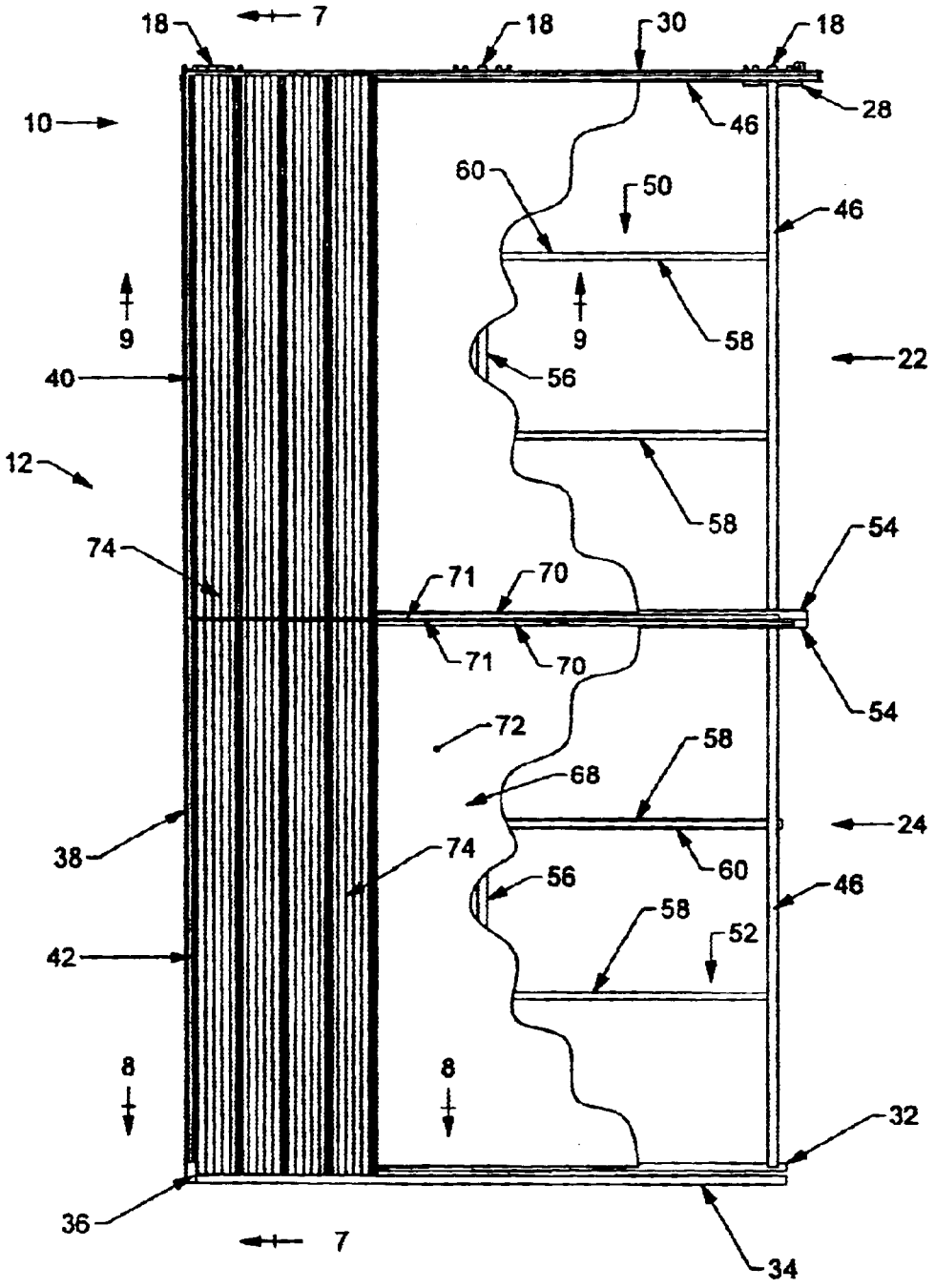
FIG. 6 is a front elevational view of the door member in a closed position with some of the insulation and cladding shown removed.
Figure 7:
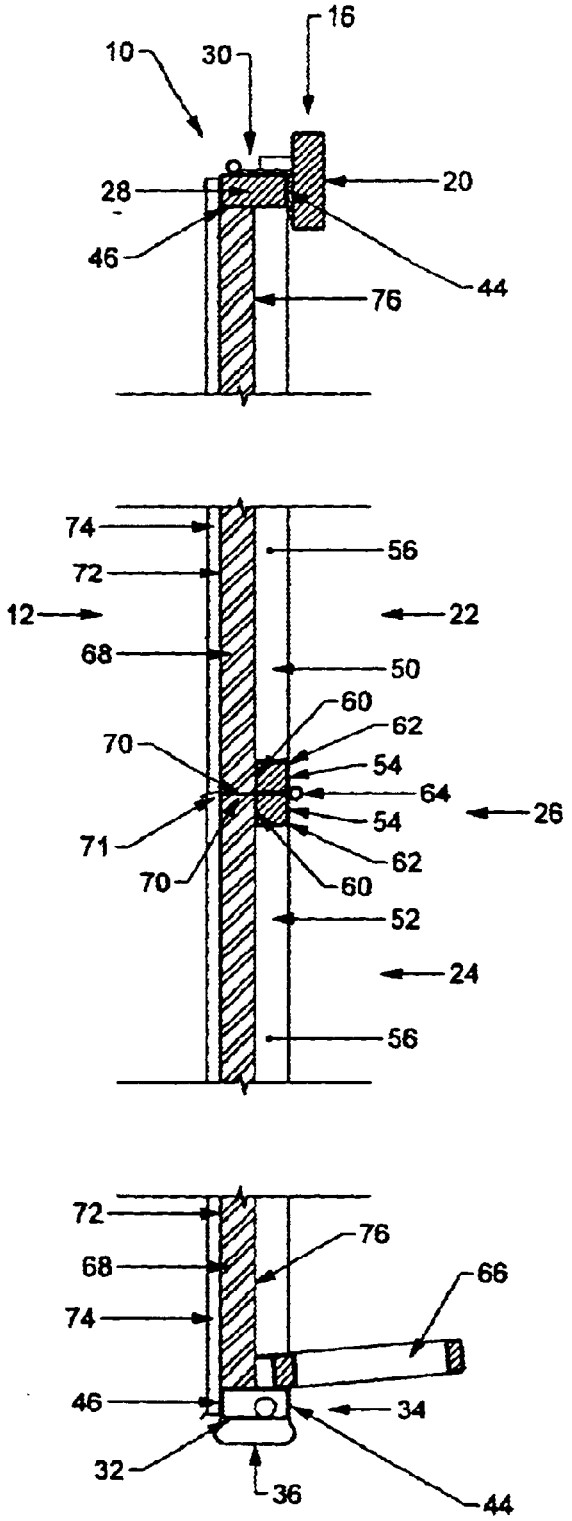
FIG. 7 is a sectional view along the line 7—7 of FIG. 6.
Figure 8:
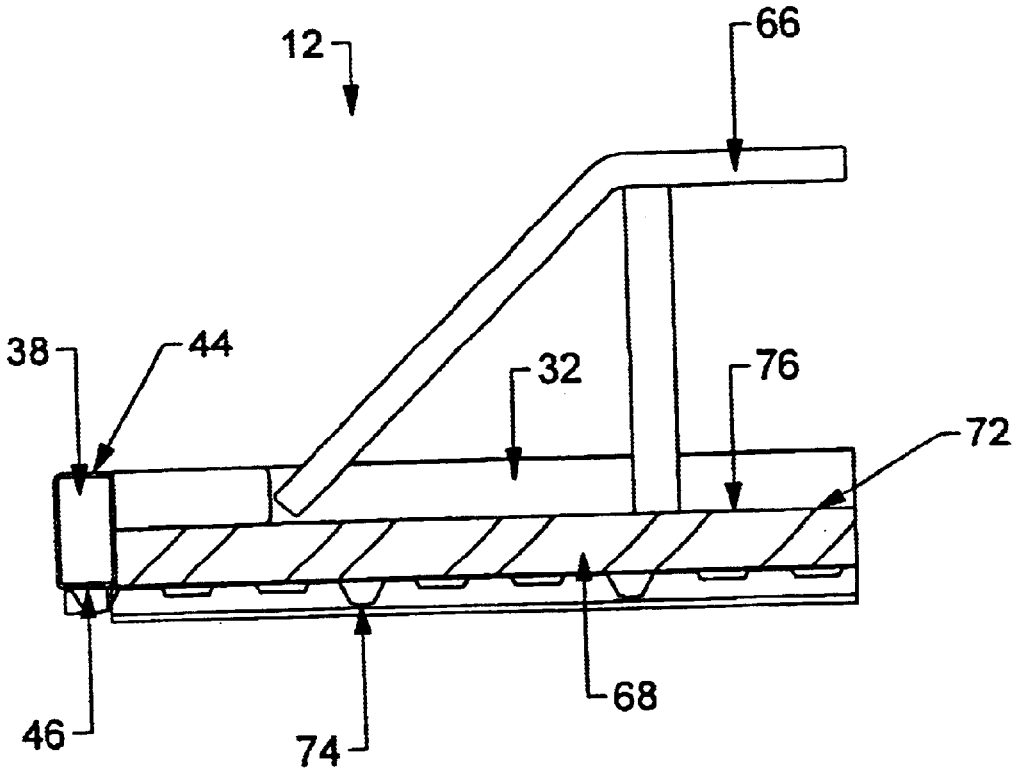
FIG. 8 is a sectional view along the line 8—8 of FIG. 6.
Figure 9:
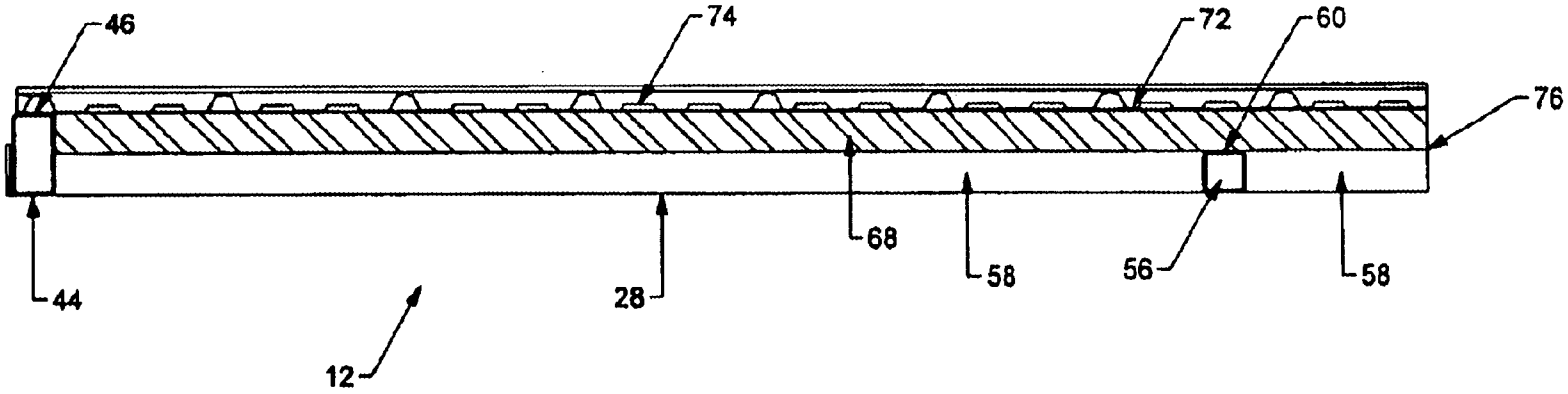
FIG. 9 is sectional view along the line 9—9 of FIG. 6.

The door member 12 includes an upper panel 22 and a lower panel 24 which are foldable relative to one another at a hinged seam 26 extending horizontally across the door member, centrally located within an inch or two, partway between the top and bottom beams. The door member is thus folded between a closed position of FIG. 1 in which the upper and lower panels lie in a generally common vertical plane spanning the door opening and the open position of FIG. 2 in which the bottom end of the door member is raised upwardly towards the top end and the panels project outwardly from the door opening of the building.

The upper panel includes a top beam 28 which spans the full length of the top end 30 of the door member. In cross section the top beam 28 is deeper than it is tall, being in the order of two inches high but four or five inches deep, so as to be generally rectangular in shape. The top beam 28 mounts the hinge brackets 18 thereon so that the top beam and door member suspended therefrom are pivotal relative to the header 20 of the door opening.

The lower panel 24 similarly includes a bottom beam 32 having similar size and shape to that of the top member 28. The top beam 32 spans a full length of the bottom end 34 of the door member and mounts a rollers 36 at respective ends thereof for rolling engagement with sides of the opening in the building as the door is opened and closed.

Two side beams 38 are provided to extend substantially a full height of the door member along opposing sides of the door member. The side beams 38 are each separated at the hinged seam 26 into an upper section 40 forming part of the upper panel and a lower section 42 forming a portion of the lower panel. Each of the top and bottom beams has a depth which is substantially identical to both of the side beams 38 with the beams being mounted so that an inner surface 44 and an outer surface of the side beams is flush with respective inner and outer surfaces of the top and bottom beams on both inner and outer sides of the door. The top beam, the bottom beam, and both side beams accordingly have respective outer surfaces 46 which lie in a generally common plane.

The upper panel includes an upper frame 50 spanning the upper sections 40 thereof, while the lower panel includes a lower frame 52 spanning the lower sections of the side beams. Each frame includes a cross beam 54 spanning the side beams directly adjacent the hinged seam 26 so that the cross beams 54 are abutted with one another on opposing sides of the hinged seam in a closed position of the door. Each frame further includes a plurality of longitudinal supports which extend vertically in a closed position of the door between the cross beam 54 and a respective one of the top and bottom beams. Lateral supports 58 are also provided which extend laterally in a horizontal direction between the longitudinal supports 56 and the respective sections of the side beams 38.

The longitudinal and lateral supports 56 and 58 are similar in dimension, having a narrower depth in cross section than either the top, bottom or side beams. The supports lie in a generally common plane in a closed position of the door, being arranged so that an inner surface of the supports lies generally. adjacent with the inner surfaces of the top, bottom and side beams so that an outer surface 60 of the supports is recessed inwardly in relation to the outer surface 46 of the top, bottom and side beams.

The cross beams in the illustrated embodiment have a depth which is greater than that of the lateral supports or longitudinal supports while having an outer surface lying in the recessed common plane with the outer surfaces 60 of the longitudinal and lateral supports. The inner ends 62 projecting from the inner side of the door are thus spaced from the inner side of the door so that hinges 64 coupling the cross beams for pivotal movement at the hinged seam 26 are spaced from the plane of the upper and lower door panels to increase spacing between the panels in the folded and open positions. Increasing the spacing between the panels permits greater room for trusses 66 supported on an inner side of the door member to extend laterally across the door for additional structural support. The trusses are arranged to project generally perpendicularly to the respective panels of the door member upon which they are mounted, except for the lowermost truss which is purposely angled to extend inwardly at an upward incline to allow clearance between the door and building.

Arranging the outer surface of the cross beams 54 and the supports 56 and 58 in a generally common recessed plane, permits sheeted insulation material 68 to be received within the recess to span between the side beams 38 and between the top and bottom beams continuously and substantially uninterrupted at a constant thickness throughout. The sheeted insulation material 68 is only interrupted by the hinged seam 26 in which a seam is provided in the sheeted insulation material so that free ends 70 of the material are abutted with one another when the upper and lower panels are in the closed position.

The abutted free ends 70 of the sheeted insulation material 68 include caps formed of suitable cladding material for weatherproofing which encloses the exposed free ends of the sheeted insulation material on either side of the hinged seam 26.

The sheeted material 68 spans laterally and longitudinally across the door member directly adjacent the outer surface of the supports and the cross beams. Thickness of the sheeted insulation material 68 is arranged so that an outer surface 72 of the insulation lies generally flush with the common plane of the outer surfaces 46 of the top, bottom and side beams. The combined thickness of the supports and insulation material is thus approximately equal to a depth of the top, bottom and side beams.

Cladding 74 is provided to overlap directly adjacent the outer surface 72 of the sheeted insulation material as well as overlap the outer surfaces 46 of the surrounding top, bottom and side beams in an abutted relationship. Threaded fasteners are provided which extend from the cladding through the sheeted insulation material to be tapped into the supports 58 and 56 and the cross beams 54. The insulation is thus secured between the cladding 74 and the upper and lower frames of the upper and lower panels. Fasteners may also be provided to secure the edges of the cladding 74 directly to the top, bottom and side beams. The cladding 74 preferably comprises a conventional type of outdoor weatherproof cladding possibly formed of suitably finished metal or plastic.

Other weatherproofing is provided by suitable J-shaped mouldings 71A and flashing strips 71B. Along the top edge of the cladding of both the panels of the door member, the mouldings 71A are provided for wrapping over the top edge, while along the bottom edge of the cladding of both panels of the door member, the flashing strips 71B are provided to project outwardly from the cladding to shed precipitation away from the edge of the cladding.

Inner sheeted material 76 is provided in the form of a layer of cladding-type material which is received directly adjacent an outer side of the supports 56 and 58 of the frames, between the frames and the sheeted insulation material 68. The resulting interior surface of the door member is thus suitably finished with the insulation being concealed by the cladding material formed of suitable plastic or metal which is waterproof to permit the inner surface of the door to be easily cleaned.

While one embodiment of the present invention has been described in the foregoing, it is to be understood that other embodiments are possible within the scope of the invention. The invention is to be considered limited solely by the scope of the appended claims.

What is claimed is:

1. An overhead bi-fold door construction comprising a door member and mounting means for supporting the door member on a building, the door member comprising:

a top beam extending along a top end of the door member;

a bottom beam extending along a bottom end of the door member;

two side beams extending along opposing sides of the door member;

a hinged seam extending across the door member partway between the top and bottom beams of the door member and dividing each side beam into a respective upper section and a respective lower section;

the door member being separated by the hinged seam into an upper panel including the top beam and the upper sections of the side beams and a lower panel including the bottom beam and the lower sections of the side beams;

the upper and lower sections of the side beams being foldable relative to one another at the hinged seam between a closed position of the door member in which the upper and lower sections lie in a generally common upright plane and an open position of the door member in which the bottom beam is raised upwardly towards the top beam in relation to the closed position;

an upper frame spanning the upper sections of side beams;

a lower frame spanning the lower sections of the side beams;

an outer surface of the upper and lower frames being recessed in relation to an outer surface of at least one of the top beam, the bottom beam and the side beams;

sheeted insulation material being supported on the outer surface of the upper and lower frame; and cladding being supported on an outer side of the sheeted insulation material.

2. The door construction according to claim 1 wherein the outer surface of the upper and lower frames are recessed in relation to the outer surface of the side beams.

3. The door construction according to claim 1 wherein the outer surface of the upper frame is recessed in relation to the outer surface of the top beam.

4. The door construction according to claim 2 wherein the outer surfaces of the top beam and upper sections of the side beams are substantially flush with one another.

5. The door construction according to claim 1 wherein the outer surface of the lower frame is recessed in relation to an outer surface of the bottom beam.

6. The door construction according to claim 4 wherein the outer surfaces of the bottom beam and the lower sections of the side beams are substantially flush with one another.

7. The door construction according to claim 1 wherein the outer side of the sheeted insulation material lies flush with the outer surfaces of said at least one of the top beam, the bottom beam and the side beams.

8. The door construction according to claim 1 wherein the cladding overlaps the outer side of the sheeted insulation material and the outer surfaces of said at least one of the top beam, the bottom beam and the side beams.

9. The door construction according to claim 1 wherein the outer surfaces of the side beams are substantially flush with an outer surface of both the top and bottom beams.

10. The door construction according to claim 8 wherein the outer side of the sheeted insulation material lies flush with the outer surfaces of all the beams.

11. The door construction according to claim 8 wherein the cladding overlaps the outer side of the sheeted insulation material and the outer surfaces of all the beams.

12. The door construction according to claim 1 wherein the sheeted insulation material spans the door member substantially uninterrupted at a substantially constant thickness between the side beams and between the top and bottom beams.

13. The door construction according to claim 11 wherein the sheeted insulation material is divided at the hinged seam defining a pair of abutting surfaces of the sheeted material in the closed position of the door member, the abutting surfaces being capped by a suitable cladding material.

14. The door construction according to claim 1 wherein each of the upper and lower frames includes a cross beam extending along the hinged seam having an outer surface which is recessed in relation to said at least one of the top beam, the bottom beam and the side beams.

15. The door construction according to claim 1 wherein the sheeted material extends between the cross beams and the cladding.

16. The door construction according to claim 1 wherein each of the upper and lower frames includes a layer of inner sheeted material spanning the side beams between the respective frame and the sheeted insulation material.

* * * * *